US005902137A

United States Patent [19]

Yodogawa

[11] Patent Number: 5,902,137

[45] **Date of Patent: *May 11, 1999**

[54] ELECTRICAL CONNECTOR

[75] Inventor: Akihiro Yodogawa, Fujisawa, Japan

[73] Assignee: BERG Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,327

[22] PCT Filed: Dec. 29, 1994

[86] PCT No.: PCT/US94/14896

§ 371 Date: Aug. 28, 1996

§ 102(e) Date: Aug. 28, 1996

[87] PCT Pub. No.: WO95/18475

PCT Pub. Date: Jul. 6, 1995

[30] Foreign Application Priority Data

Dec. 29, 1993 [JP] Japan ..... 5-74877 U
Mar. 8, 1994 [JP] Japan ..... 6-36827

[51] Int. Cl.[6] ..... H01R 9/09

[52] U.S. Cl. ..... 439/76.1; 439/654; 439/946

[58] Field of Search ..... 439/76.1, 945, 439/946, 654

[56] References Cited

U.S. PATENT DOCUMENTS 5,155,663 10/1992 Harase ..... 361/395
5,207,586 5/1993 MacGregor et al. ..... 439/76
5,242,310 9/1993 Leung ..... 439/76
5,330,360 7/1994 Marsh et al. ..... 439/76
5,413,490 5/1995 Tan et al. ..... 439/76.1
5,477,426 12/1995 Bethurum ..... 439/76.1
5,505,628 4/1996 Ramey et al. ..... 439/76.1

FOREIGN PATENT DOCUMENTS 427521 11/1990 European Pat. Off. .

*Primary Examiner*—Gary Paumen
*Attorney, Agent, or Firm*—Woodcock Washburn Kurtz Mackiewicz & Norris LLP

[57] ABSTRACT

A connector which can connect a personal computer designed to use a memory card as an external memory medium to an external storage device or medium via the connection for the memory card. The housing (4) of a card type connector (2) is designed to have an external shape and size substantially the same as a standardized memory card. By inserting the housing (4) into a memory card connector (22) of a personal computer (200), the personal computer (200) and a hard disk drive (210) are connected by a cable (36) extending from the housing (4) of the card type connector (2), so that data transmission and reception can be performed between the personal computer (200) and the hard disk drive (210).

7 Claims, 8 Drawing Sheets

ELECTRICAL CONNECTOR

FIELD OF THE INVENTION

The present invention relates to electrical connectors having a shape similar to that of a memory card and, in particular, to an electrical connector for connecting a data processing device, for example, a personal computer, to an external memory device, for example, a hard disk drive.

BACKGROUND OF THE INVENTION

External memory mediums or devices electrically connectable to the personal computer, e.g., a memory card, a hard disk drive, etc. are used to increase the storage capacity of the personal computer. The storage capacity of these devices varies. The memory capacity of a memory card is determined and limited by the number of memory elements incorporated therein and the memory capacity of each individual memory element. As a consequence, when a memory card is used for applications requiring a large memory capacity, the memory elements must each have a large memory capacity.

However, because memory cards are designed to be compact, the number and capacity of the memory elements incorporated therein is restricted. In view of the limited memory capacity of a memory card, in some applications, it may be desirable to use the hard disk drive as an external storage device due to its greater memory capacity. In addition to the limited capacity, memory cards are generally expensive due to the cost of the memory elements incorporated therein.

In the Japanese market, for example, a typical memory card, for example, a Static Random Access Memory ("SRAM") type memory card with a 1 MB to 2 MB memory capacity costs about 20,000 to 30,000 yen. Further, a memory card with a 10 MB to 20 MB memory capacity (requiring memory elements of greater memory capacity, such as a flash memory) costs about 200,000 to 300,000 yen. In contrast thereto, a hard disk drive costs about 80,000 yen for a memory capacity of 80 MB, about 100,000 yen for a memory capacity of 100 MB, and about 150,000 yen for a memory capacity of 200 MB.

Therefore, in view of the comparison between memory capacity and price, it may be desirable to use the hard disk drive rather than a memory card in certain applications because hard disk drives have a larger memory capacity than memory cards and are also less expensive.

Because the hard disk drive is larger than the memory card, it is difficult to load it into a compact personal computer, in particular, into a notebook computer. As a consequence, most compact computers are designed to have a memory card insertion slot or a connector for a memory card so that they may use a memory card as an external memory medium. In order to connect a hard disk drive to a computer designed as described above, a new connector is needed.

SUMMARY OF THE INVENTION

It is, therefore, an object of the present invention to provide an electrical connector which can meet the above-mentioned need. In particular, an object of the present invention is to provide an electrical connector which can be used to connect a data processing device designed to use a memory card as an external memory medium to other inexpensive external memory devices having large memory capacity.

According to one aspect of the present invention, an electrical connector is provided which can electrically connect a data processing device via a connection for a memory card to an external memory device via a cable adapted to interface to the external memory device.

The electrical connector includes a frame having an outer dimension substantially the same as that of the memory card and a plurality of connection elements located at one end and at another end in its longitudinal direction, the plurality of connection elements located at the one end being adapted to be electrically connectable to the data processing device via the connection for the memory card, and the plurality of connection elements located at the other end being adapted to be electrically connectable to the cable.

The electrical connector may further include a board held in the frame and having a circuit for electrically connecting the connection elements located at the one end of the frame to the connection elements located at the other end of the frame.

According to a further aspect of the present invention, an electrical connector is provided which includes a board having a plurality of connection elements at one end adapted to be electrically connectable to the data processing device via the connection for the memory card, having another end being electrically connectable to the cable, and having a circuit for electrically connecting the one end to the other end.

The electrical connector further includes a frame having an external dimension substantially the same as that of the memory card and holding the board therein.

Preferably, the data processing device to be connected to these electrical connectors has a space for receiving the memory card and the frame of the electrical connector is adapted to be inserted into the receiving space for the memory card.

According to a further aspect of the present invention, an electrical connector is provided which electrically connects a data processing device via a connection for a memory card to an external memory device via a cable adapted to interface the external memory device, the data processing device including a space for receiving the memory card and a hook for latching the memory card inserted in the memory card receiving space.

The electrical connector includes a board having a plurality of connection elements at one end adapted to be electrically connectable to the data processing device via the connection for the memory card, having another end being electrically connectable to the cable, and having a circuit for electrically connecting the one end to the other end.

The electrical connector further includes a frame holding the board therein, including a first portion placed on a connection element side of the board and having an outer dimension substantially the same as that of the memory card so as to be insertable into the memory card receiving space of the data processing device, a second portion extending from the first portion and placed on a cable connection side of the board, and an engaging portion between the first portion and the second portion configured to be engagable with the hook of the data processing device for latching the memory card.

In this embodiment of the invention, the width of the second portion of the housing may be greater than the width of the first portion of the housing. In addition, the data processing device in this embodiment may have an electrical connector for forming an electrical connection with the memory card and the memory card receiving space and the engaging hook of the data processing device are provided in the electrical connector for the memory card.

In the above described electrical connector of the present invention, electronic circuit components may be mounted on the board.

According to another embodiment of the invention, an electrical connector is provided for electrically connecting a data processing device via a connection for a memory card to an external memory device.

The electrical connector includes a frame having an outer dimension substantially the same as that of the memory card and a flexible circuit board having a plurality of connection elements at its one end, a plurality of connection elements at the other end and a circuit for electrically connecting the one end to the other end, the one end being held in the frame, the connection elements at the one end being adapted to be electrically connectable to the data processing device via the connection for the memory card, the other end extending from the frame, and the connection elements at the other end being adapted to be electrically connectable to the external memory device.

In the aforementioned electrical connectors, the frame desirably has a cover for covering the board held in the frame. In addition, in the aforementioned electrical connectors, at least one group of the connection elements at the one end and at least one group of the connection elements at the other end are male or female elements.

The data processing device and the external memory device being electrically connected by the electrical connector of the present invention are typically a personal computer and a hard disk drive, respectively. In addition, the term "personal computer" should be understood to cover a compact version of a personal computer, that is, a laptop, a notebook and a palmtop computer.

DETAILED DESCRIPTION OF THE PREFERRED EMBODIMENTS

Figure 1:
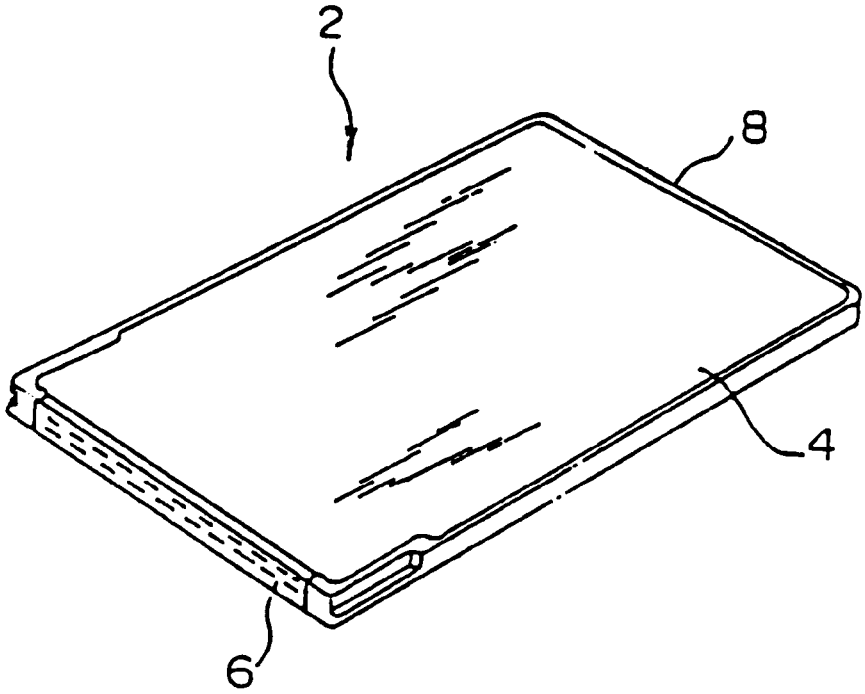
FIG. 1 is a perspective view of a card-type connector according to a first embodiment of the present invention.

Referring to FIG. 1, an electrical connector 2 of the present invention is shown. The housing 4 of the electrical connector or card-type connector 2 is designed to have substantially the same outer dimension as that of a standard memory card. For example, memory cards are standardized under Japan Electronic Industry Development Association ("JEIDA"). The housing 4 of the electrical connector 2 may be configured according to the standards set forth under JEIDA.

Figure 2:
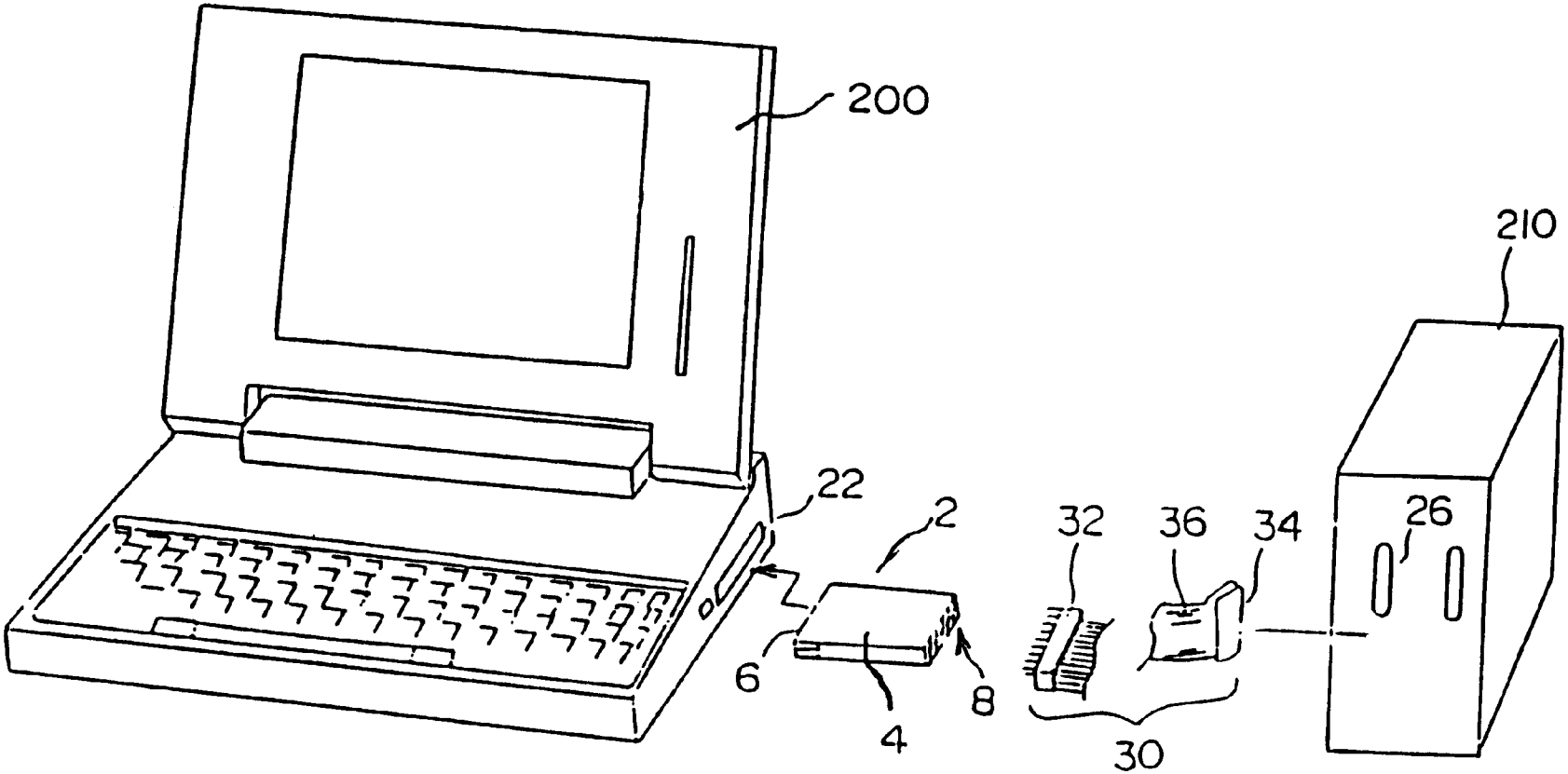
FIG. 2 is a perspective view of the card type connector of FIG. 1 as well as a system having a personal computer and a hard disk drive both of which are to be connected to each other by the connector.

As a consequence, the housing 4 of the electrical connector 2 may fit into the connection for a memory card for a personal computer as shown in FIG. 2. In particular, the housing 4 of the electrical connector 2 may be connected to the memory card insertion slot or a connector 22 provided in the personal computer 200.

Figure 3:
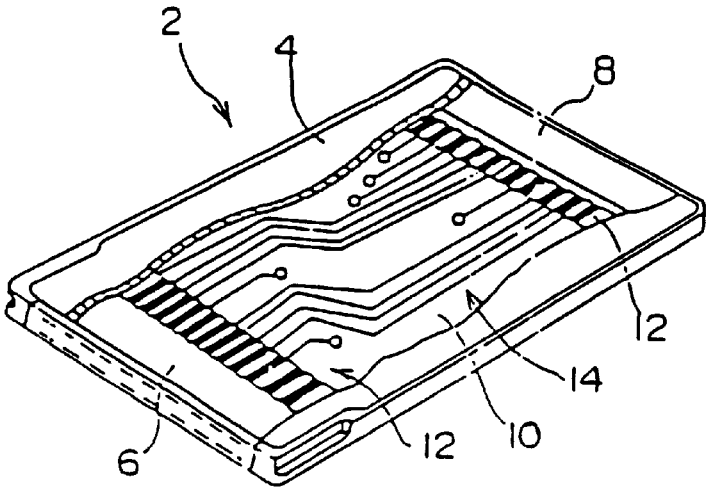
FIG. 3 is a perspective view of the card type connector of FIG. 1 with its housing partly broken away.

The embodiment of the electrical connector 2 is discussed in more detail with reference to FIG. 3. In particular, the housing 4 of the card-type connector 2 has female connector units or elements 6 and 8 at its front and rear ends. These two female connector units 6 and 8 are electrically connected to each other by a rigid printed circuit board 10 housed in the housing 4. In detail, a plurality of contact terminals 12 in the respective female connector units 6 and 8 are soldered to the circuit pattern 14 on the printed circuit board 10. The female connector units 6 and 8 are similar to connector units used in a well known memory cards, as a consequence, their structure is well known.

In practice, as shown in FIG. 2, the female connector unit 6 at the front end of card type connector 2 can be connected to a male connector unit, not shown, located in the memory card connector 22 in the personal computer 200. The female connector unit 8 at the rear end of the connector 2 can be connected to a male connector unit 32 of a well known harness 30 for connecting the card type connector 2 to a hard disk drive ("HDD") 210. The harness 30 includes the male connector unit 32, a female connector unit 34 to be connected to a male connector unit 26 of the HDD 210, and a cable 36 for electrically connecting the male connector unit 32 and the female connector unit 34.

As shown in FIG. 2, the personal computer 200 can be connected to the HDD 210 by the card-type connector 2 and the harness 30 by inserting the housing 4 of the card-type connector 2 into the memory card connector 22 of the personal computer 200. As a result, data transmission and reception can be performed between the personal computer 200 and the HDD 210.

Figure 4:
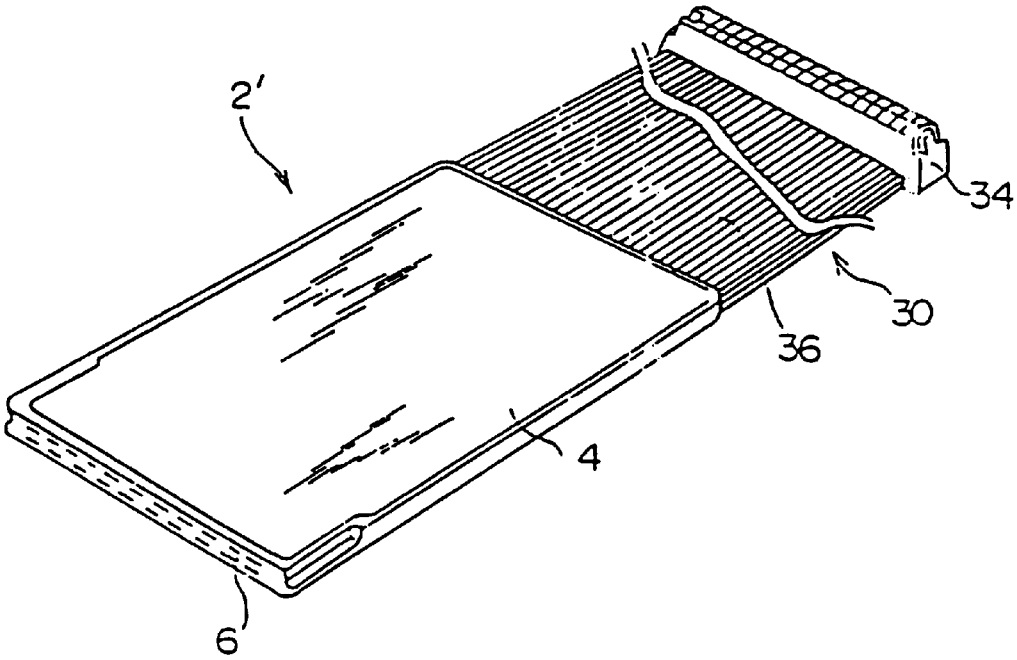
FIG. 4 is a perspective view of a card type connector according to a second embodiment of the present invention.

Referring to FIG. 4, a card-type connector 2' according to a second embodiment of the present invention is shown. The connector 2' has a housing 4 and a printed circuit board 10 both of which are similar to those in the first embodiment. One major difference between the first embodiment and the second embodiment is in the system for connecting the card type connector 2' to the well known harness 30.

Figure 5:
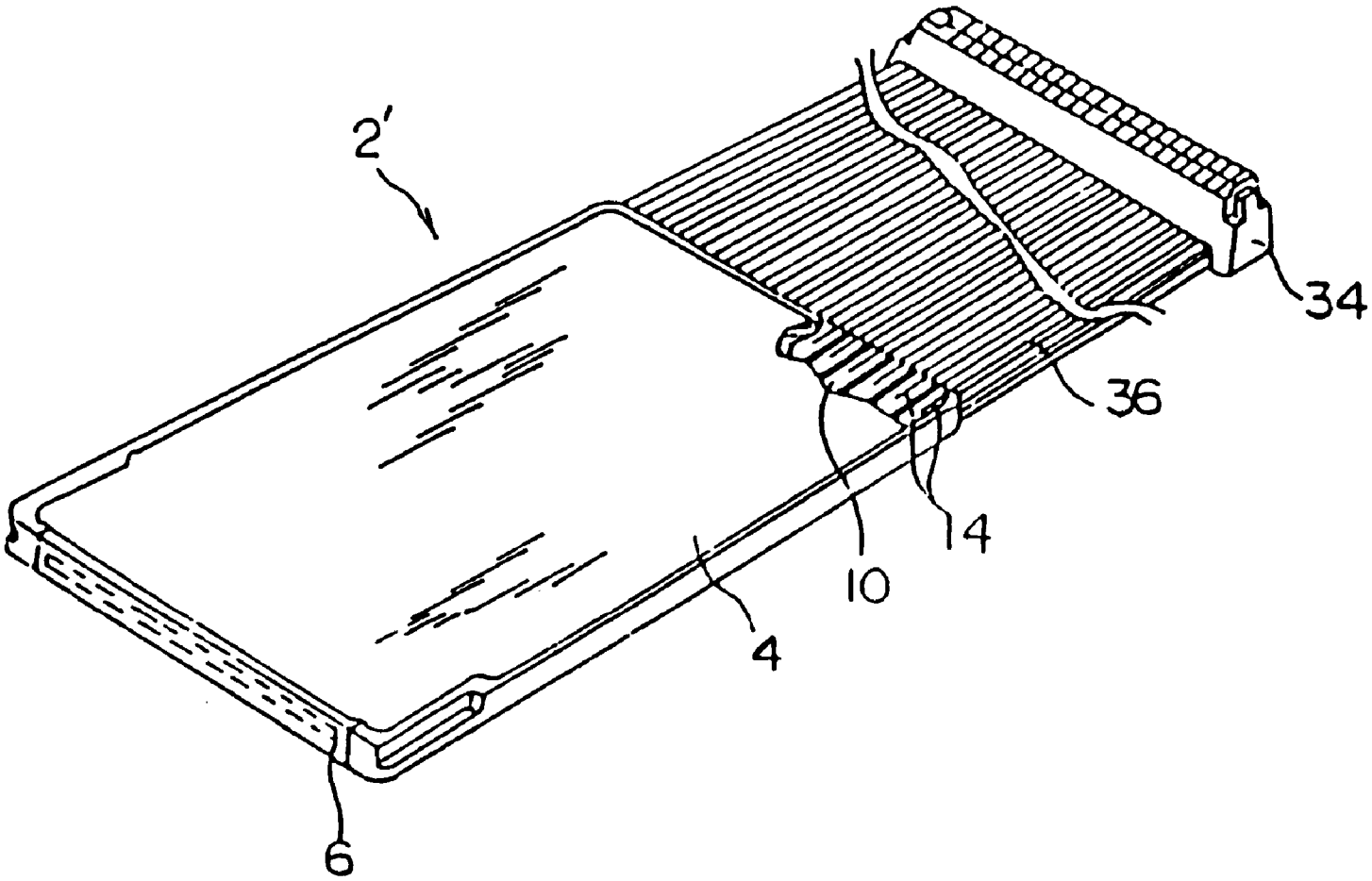
FIG. 5 is a perspective view of the card type connector of FIG. 4 with its housing partly taken away.

As shown in more detail in FIG. 5, the card-type connector 2' of the second embodiment has no female connector unit 8 at its rear end (HDD side) and the cable 36 of the harness 30 has no male connector unit 32 (corresponding to the female connector unit 8 in the first embodiment of the invention). In this embodiment, portions of conductors on the PC-side end of the cable 36 of the harness are soldered directly to a circuit pattern 14 on the printed circuit board 10 in the housing 4 of the card-type connector 2'.

As a consequence, when the housing 4 of the card-type connector 2' is inserted into the memory card connector 22 (FIG. 2) in the personal computer 200, the personal computer 200 can be connected to the HDD 210 (FIG. 2) (as in the case of the first embodiment) enabling data transmission and reception between the personal computer 200 and HDD 210 via the electrical connector 2' of the second embodiment of the invention.

Figure 6:
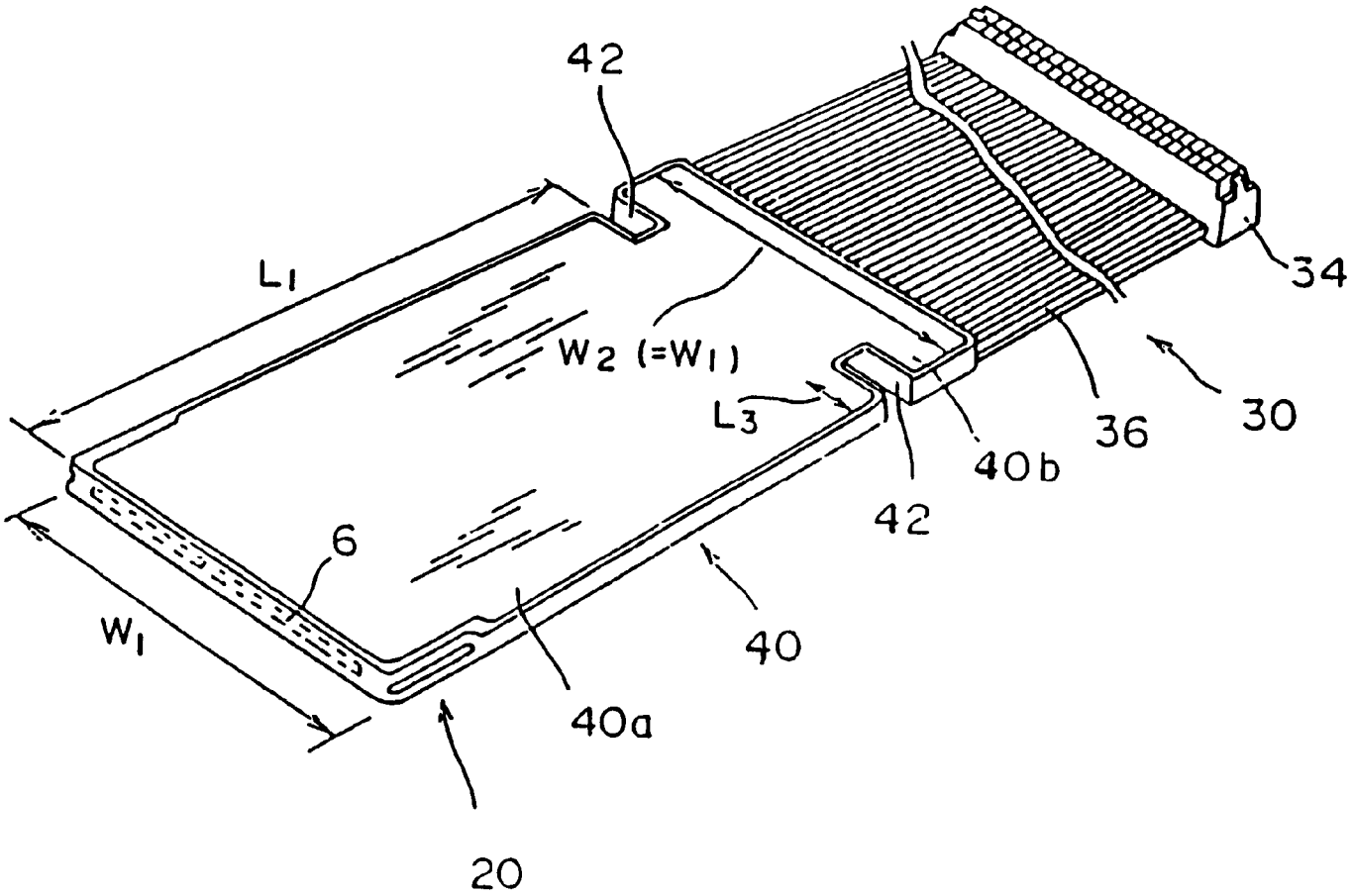
FIG. 6 is a perspective view of a card type connector according to a third embodiment of the present invention.

Referring to FIG. 6, a card-type connector 20 according to a third embodiment of the present invention is shown. The card type connector 20 is designed to be latched by memory card latching hooks (not shown) provided in the memory card connector 22 (FIG. 2) of the personal computer 200. In the memory card connectors, latching hooks are well known which perform latching engagement with a rear end of the memory card inserted into the memory card connector to prevent the memory card from accidentally ejecting out from the memory card connector while the memory card transmits data to the personal computer or receives data therefrom. The card type connector 20 is configured to engage such well known latches so that the card 20 will not become dislodged upon insertion in the memory card connector 22 of the personal computer 200 according to the third embodiment of the invention.

In particular, the card type connector 20 has a housing 40, and the housing 40 is divided into a front portion 40*a* and a rear portion 40*b* by a pair of grooves 42 opposed in its width direction. Length L1 of the front portion 40*a* of the housing 40 is equal to that of the standardized memory card. The width $W_1$ and $W_2$ (here $W_1=W_2$) of the front and rear portions 40*a* and 40*b* of the housing 40 are equal to that of the standardized memory card. The grooves 42 are adapted to be engaged with the latching hooks of the above-mentioned memory card connector 22 so that the card 20 will become securably engaged to the memory card connector 22 upon insertion therein.

A printed circuit board (not shown) having a configuration corresponding to that of the housing 40 is housed in the housing 40. A plurality of contact terminals of a female connector unit 6 (as shown in the first embodiment) are soldered to a front end (PC side) of a circuit pattern on the printed circuit board. In the same manner as in the second embodiment, conductors on the PC-side end of the cable 36 of the harness 30 are soldered to a rear end (HDD side) of the circuit pattern on the printed circuit board of the card connector 20.

When the front portion 40*a* of the housing 40 of the card type connector 20 is inserted into the memory card connector 22 of the personal computer 200, the card type connector 20 can connect the personal computer 200 to the HDD 210 (FIG. 2) to enable the personal computer 200 to transmit data to the HDD 210 and to receive data from the HDD 210 in the same manner as in the first and second embodiments of the invention.

In addition, the engagement of the latch hooks of the memory card connector 22 with the grooves 42 of the card-type connector 20 enables the card-type connector 20 to be securely electrically connected to the memory card connector 22. As a consequence, the card type connector 20 prevents accidental disconnection from the personal computer 200 where an accidental disconnection may cause operation error when data transfer (transmission and reception) is being performed between the personal computer 200 and the HDD 210.

Figure 7:
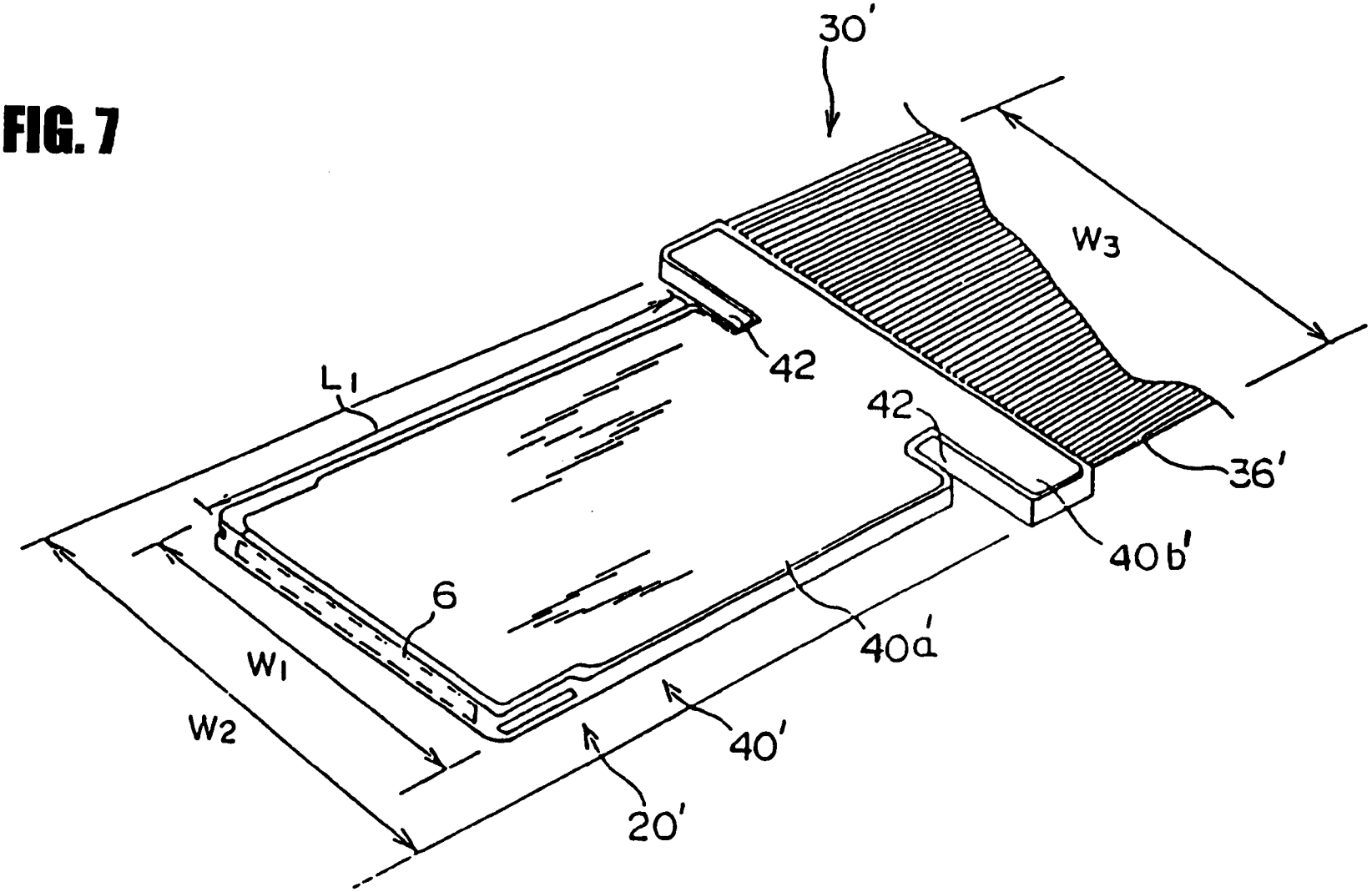
FIG. 7 is a perspective view of a card type connector according to a fourth embodiment of the present invention.

Referring to FIG. 7, a card type connector 20 according to a fourth embodiment of the present invention is shown. A housing 40' has a front portion 40*a'* having the same shape and size as a standardized memory card. One difference between the fourth embodiment and the third embodiment of the connector of the present invention is the rear portion of the connector. In particular, the rear portion 40*b'* of the housing 40' of the fourth embodiment of the invention is designed to be connected to a cable 36' of a harness 30' having width $W_3$ greater than the standard width of a memory card. The width $W_2$ of a rear portion 40*b'* of the housing 40' is greater than the width $W_1$ of the front portion 40*a'* ($W_2>W_1$) where the width $W_1$ of the front portion 40*a'* is substantially equal to the standard width of a memory card. Similarly, the width of a rear end of a printed circuit board (not shown) in the housing 40' is greater than that of a front end of the printed circuit board.

In a card type connector 20 of the third embodiment as shown in FIG. 6, if the width $W_3$ of the cable is not substantially equal to $W_1$, the cable cannot be soldered to the printed circuit board 10. In contrast to this, in the fourth embodiment shown in FIG. 7, it is possible to connect the cable 36' having a relatively larger width $W_3$ to the printed circuit board 10 by setting the width $W_2$ of the rear portion 40*b'* of the housing 40' to have the relationship $W_2>W_3>W_1$.

Figure 8:
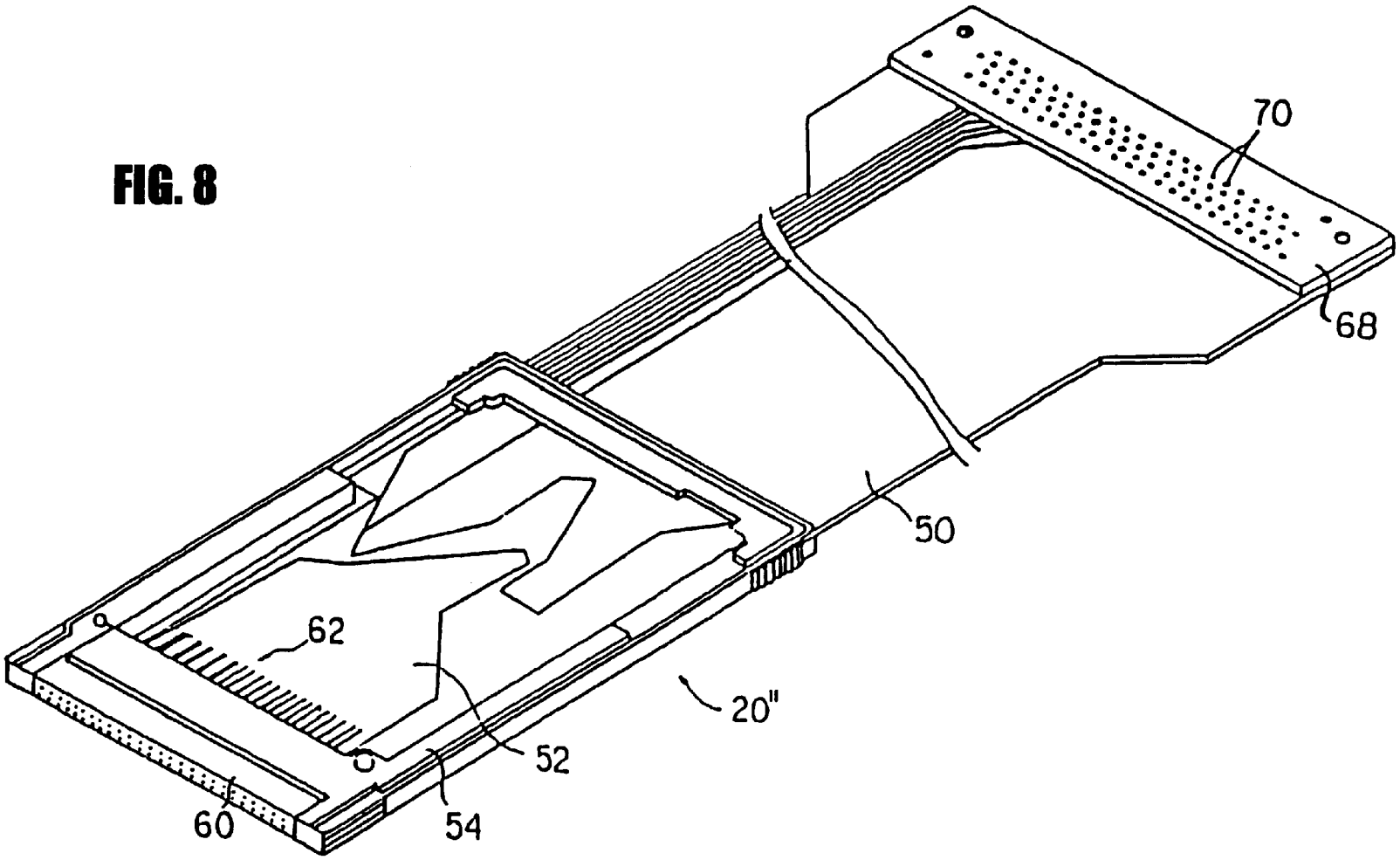
FIG. 8 is a perspective view of a card type connector according to a fifth embodiment of the present invention.

Referring to FIG. 8, a card-type connector 20" according to a fifth embodiment of the present invention is shown. One difference between the fifth embodiment of the invention and the first embodiment of the invention is that a flexible printed circuit board 50 is used in place of the rigid printed circuit board 10. The printed circuit board 50 of this embodiment uses a three-layered board. Connector elements on each end of the board 50 are connected by a circuit pattern 52 formed on the circuit board 50. The frame 54 of the connector 20" is designed to have substantially the same outer shape and outer size as a standard memory card.

Figure 9:
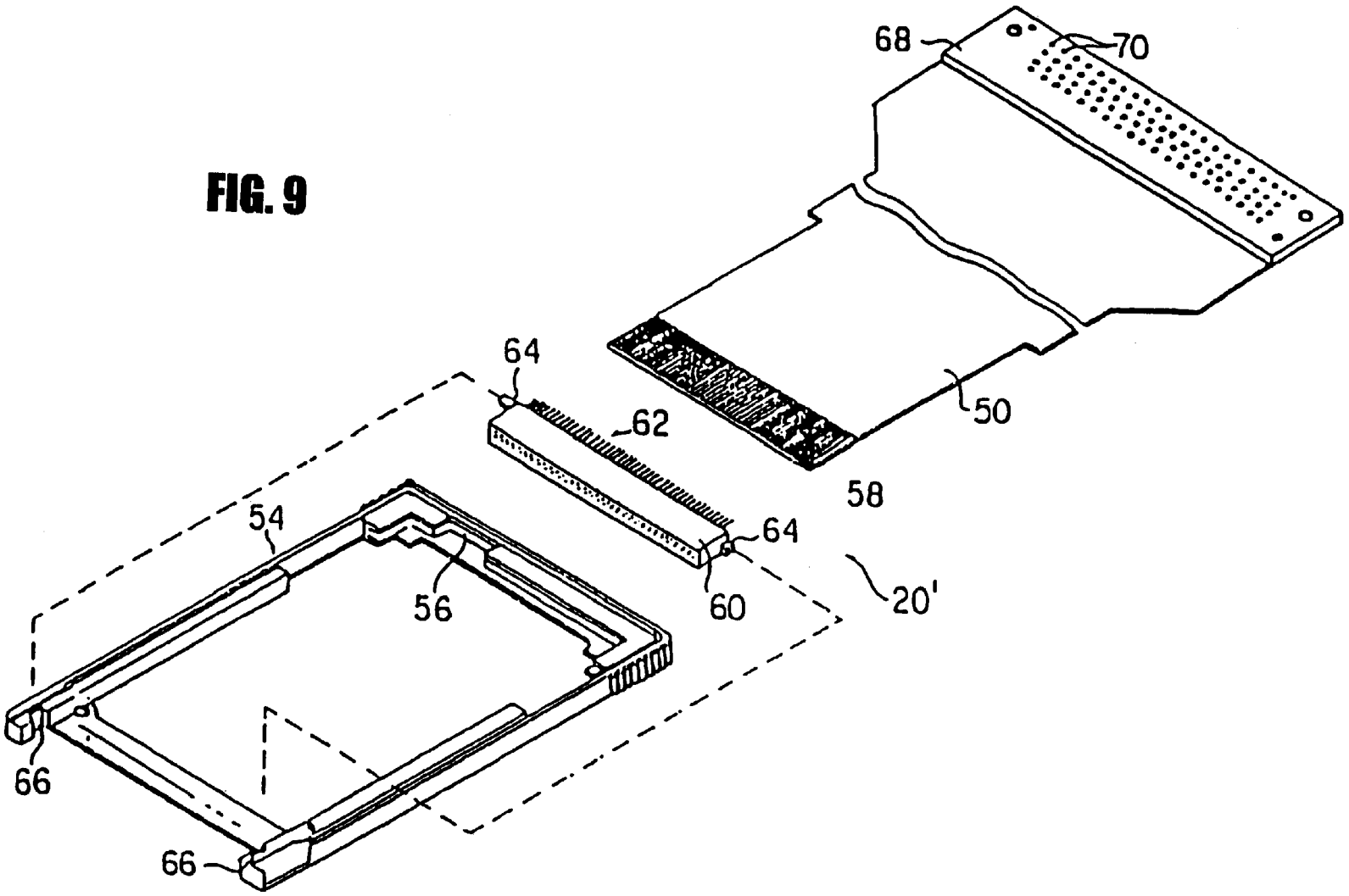
FIG. 9 is an exploded perspective view of the card type connector of FIG. 8 as viewed from its bottom side.

As shown in FIG. 9, the frame 54 of the connector 20" has an opening 56 at its rear end. In this embodiment, one end 58 of the flexible printed circuit board 50 is inserted into the frame 54 through the opening 56 and is soldered to a female connector unit 60 equipped with a plurality of conductive female terminals or elements 62.

The female connector unit 60 has lugs 64 at its both ends. The female connector unit 60 is fitted in the frame 54 by inserting the lugs 64 into corresponding grooves 66 in the front end of the frame 54. The female connector unit 60 can be electrically connected to a personal computer 200 (not shown in FIG. 9). In this embodiment of the invention, the other end of the flexible printed circuit board 50, extending out from the frame 54 through the opening 56, is soldered to a relatively small rigid board 68.

The rigid board 68 has a plurality of through holes 70 which are connectable to a connector (not shown in FIG. 9) of the HDD 210. When the frame 54 of the connector 20" is inserted into the memory card connector 22 of the personal computer 200, the personal computer is connected to the HDD 210 so that data transmission and reception can be performed between the personal computer and the HDD.

Finally, the frame 54, preferably, has covers (not shown) at its upper and lower surfaces to prevent the circuit pattern 52 from short circuiting.

The present invention is not limited to the above mentioned embodiments. Various changes and modifications of the present invention can be made without departing from the spirit and scope of the present invention. For example, in the first to fourth embodiments, if there is no risk of short circuit of the circuit pattern on the circuit board, the housings of these embodiments may be replaced with a frame which exposes the circuit board held therein as in the fifth embodiment.

Although, in the respective embodiments, the circuit board in the housing of the card type connector has only the circuit pattern, it may be possible to mount electronic circuit components on the circuit board.

Other standards for the design the housing of the card type connector may be used in addition to the standard for the memory card under the JEIDA. For example, the standard of the Personal Computer's Memory Card International Association ("PCMCIA") or other standards may be used.

What is claimed is:

1. An electrical connector for electrically connecting a first end of a cable to a data processing device via a memory card slot of the data processing device, the cable having a second end connected to an external memory device, comprising:

a frame having an outer dimension substantially the same as that of the memory card slot and a plurality of connection elements located at one end and at another end in its longitudinal direction, the plurality of connection elements located at the one end being adapted to be electrically connectable to the data processing device via the memory card slot, and the plurality of connection elements located at the other end being adapted to be electrically connectable to the first end of the cable; and a board held in the frame, said board having a plurality of leads mounted thereon which electrically connect the connection elements located at the one end of the frame to the connection elements located at the other end of the frame so as to provide at least one continuous circuit path having no electrical components therein between said connection elements at said one end and said other end of the frame.

2. An electrical connector according to claim 1, wherein electronic circuit components are mounted on the board.

3. An electrical connector according to claim 1, wherein at least one group of the connection elements at the one end and at least one group of the connection elements at the other end are male elements.

4. An electrical connector according to claim 1, wherein at least one group of the connection elements at the one end and at least one group of the connection elements at the other end are female elements.

5. An electrical connector according to claim 1, wherein the frame has a cover for covering the board held in the frame.

6. An electrical connector according to claim 1, wherein the data processing device is a personal computer.

7. An electrical connector according to claim 1, wherein the external memory device is a hard disk drive.

* * * * *